US007711251B2

(12) United States Patent
Barkey

(10) Patent No.: US 7,711,251 B2
(45) Date of Patent: May 4, 2010

(54) DEVICE FOR TEMPERATURE CONTROLLED HEATING OF A FLUID LINE

(75) Inventor: Volker Barkey, Bielefeld (DE)

(73) Assignee: Barkey GmbH & Co. KG, Leopoldshohe (DE)

( * ) Notice: Subject to any disclaimer, the term of this patent is extended or adjusted under 35 U.S.C. 154(b) by 457 days.

(21) Appl. No.: 11/645,694

(22) Filed: Dec. 27, 2006

(65) Prior Publication Data

US 2008/0159726 A1 Jul. 3, 2008

(51) Int. Cl.
*E03B 7/10* (2006.01)

(52) U.S. Cl. ..... 392/468; 392/465; 392/472

(58) Field of Classification Search ..... None
See application file for complete search history.

(56) References Cited

U.S. PATENT DOCUMENTS

| | | | | | |
|---|---|---|---|---|---|
| 2,687,626 | A * | 8/1954 | Bartlowe | ..... | 62/276 |
| 4,038,519 | A * | 7/1977 | Foucras | ..... | 392/472 |
| 4,170,901 | A * | 10/1979 | Conkle et al. | ..... | 73/863.12 |
| 4,214,147 | A * | 7/1980 | Kraver | ..... | 392/468 |
| 4,371,777 | A * | 2/1983 | Roller et al. | ..... | 392/480 |
| 5,601,894 | A * | 2/1997 | Maruschak | ..... | 428/36.9 |
| 5,724,478 | A * | 3/1998 | Thweatt | ..... | 392/484 |
| 6,330,395 | B1 * | 12/2001 | Wu | ..... | 392/494 |
| 6,442,341 | B1 * | 8/2002 | Wu | ..... | 392/479 |
| 6,608,968 | B2 | 8/2003 | Bakke | | |
| 6,746,439 | B2 * | 6/2004 | Lenker | ..... | 604/500 |
| 2002/0156451 | A1 | 10/2002 | Lenker | | |
| 2003/0059213 | A1 * | 3/2003 | Mackie et al. | ..... | 392/480 |

FOREIGN PATENT DOCUMENTS

| | | | |
|---|---|---|---|
| DE | 93 18 886.2 | B1 | 3/1994 |
| DE | 93 19 069.7 | U1 | 3/1994 |
| DE | 42 41 830 | A1 | 6/1994 |
| DE | 44 44 180 | A1 | 6/1995 |
| DE | 299 17 247 | U1 | 2/2000 |
| DE | 298 24 013 | U1 | 4/2000 |
| DE | 202 13 225 | U1 | 11/2002 |
| DE | 697 11 023 | T2 | 11/2002 |
| DE | 202 19 055 | U1 | 5/2003 |
| EP | 0 873 147 | B1 | 3/2002 |

* cited by examiner

*Primary Examiner*—Thor S Campbell
(74) *Attorney, Agent, or Firm*—Birch, Stewart, Kolasch & Birch, LLP

(57) ABSTRACT

The invention relates to a device for temperature controlled heating of a fluid line which comprises a jacket conduit made of a flexible material and provided with a longitudinal slot across which a fluid line is insertable into a cavity of said jacket conduit, at least one heating element extending in longitudinal direction of said jacket conduit and one temperature sensor each arranged in a first and a second section of the jacket conduit, wherein at both sides of a longitudinal center plane (M) extending through the longitudinal slot (5) the jacket conduit (1, 21) is provided with at least one circumferential section (7, 8, 22, 23) having a plurality of continuous longitudinal channels (9, 9', 10, 10', 13, 13', 13", 26, 26') and/or intermittent longitudinal channels (13, 13', 13") adapted to accommodate at least two heating elements (11) and/or at least one temperature sensor (14, 15), said continuous longitudinal channels (9, 9', 10, 10', 13, 13', 13", 26, 26') and/or intermittent longitudinal channels (13, 13', 13") extending symmetrically to said longitudinal center plane (M) of the jacket conduit (1, 21) and/or to a center plane of said circumferential section (7, 8, 22, 23).

8 Claims, 3 Drawing Sheets

DEVICE FOR TEMPERATURE CONTROLLED HEATING OF A FLUID LINE

This present invention relates to a device for temperature controlled heating of a fluid line which comprises a jacket conduit made of a flexible material and provided with a longitudinal slot across which a fluid line is insertable into a cavity of said jacket conduit, at least one heating element extending in longitudinal direction of said jacket conduit and one temperature sensor each arranged in a first and a second section of the jacket conduit.

Prior known from DE 44 44 180 C2 is a device for temperature controlled heating of a fluid line which comprises a jacket conduit provided with a cylindrical cavity. Said jacket conduit is further provided with a longitudinal slot permitting the fluid line to be inserted into said jacket conduit cavity. While inserted the fluid line is almost completely encompassed by the jacket conduit. Heating elements integrated in the jacket conduit permit temperature controlled heating of the fluid line.

To regulate the temperature of the fluid carried in the fluid line there is one temperature sensor each provided directly at the inlet and the outlet of the jacket conduit and in communication with a regulating unit. This prior art field-proven device is however affected by the drawback that the temperature sensors are integrated in the jacket conduit by means of an additional connecting piece which is adapted to be inserted into the jacket conduit. This implies that the temperature sensors are not introduced into the jacket conduit until by the time said latter is connected to the regulating unit.

It is an object of this present invention, therefore, to improve on a device for temperature controlled heating of a fluid line such as to enhance the introduction of heat from a jacket conduit surrounding the fluid line into said latter.

To achieve this object the invention is in conjunction with the preamble of claim 1 characterized by the fact that at both sides of a longitudinal center plane extending through a longitudinal slot the jacket conduit is provided with at least one circumferential section having a plurality of continuous and/or intermittent longitudinal channels which are adapted to accommodate at least two heating elements and/or at least one temperature sensor, said continuous and/or intermittent longitudinal channels extending symmetrically to said longitudinal center plane of the jacket conduit and/or to a center plane of said circumferential section.

The particular advantage afforded by the present invention resides in that homogeneous heating of the fluid carried by the fluid line is achievable in radial direction of the jacket conduit due to a symmetrical arrangement of a plurality of longitudinal channels to accommodate heating elements and/or temperature sensors. The fluid line can be uniformly heated in circumferential direction. Particularly in the case of comparatively short fluid lines can the temperature condition of the fluid leaving the fluid line be improved.

In a preferred embodiment of this present invention there is a hollow channel provided between two longitudinal channels for accommodation of heating elements in which at least one temperature sensor and at least one contact line connecting said temperature sensor to a regulating unit are disposed. Said hollow channel serves a dual purpose, namely on the one hand to accommodate the temperature sensor and the contact line, respectively, and on the other hand to benefit of the higher thermal conductivity of the air filling the hollow channel compared to that of the jacket conduit material, in order to promote homogenization of heat introduction along the circumference of the fluid line. This permits the number of heating elements to be advantageously reduced. Said air-filled hollow channel may also serve as external insulation for the jacket conduit.

One improvement of this present invention provides for the hollow channel accommodating the temperature sensor to have the cross section of a long hole that extends between two opposed heating elements of one jacket conduit circumferential section. The jacket conduit hence comprises both heating elements and air carrying hollow channels along its circumferential sections at predetermined radial spacings.

Another improvement of this invention relates to a jacket conduit having a first and a second circumferential section each of which has the cross-sectional shape of a kidney. A longitudinal notch is provided within a junction area between said first and second circumferential sections to increase the flexibility of the jacket conduit which is preferably provided in the form of a jacket hose.

Exemplary embodiments of the present invention will now be described with reference to the drawings in which.

Figure 1:
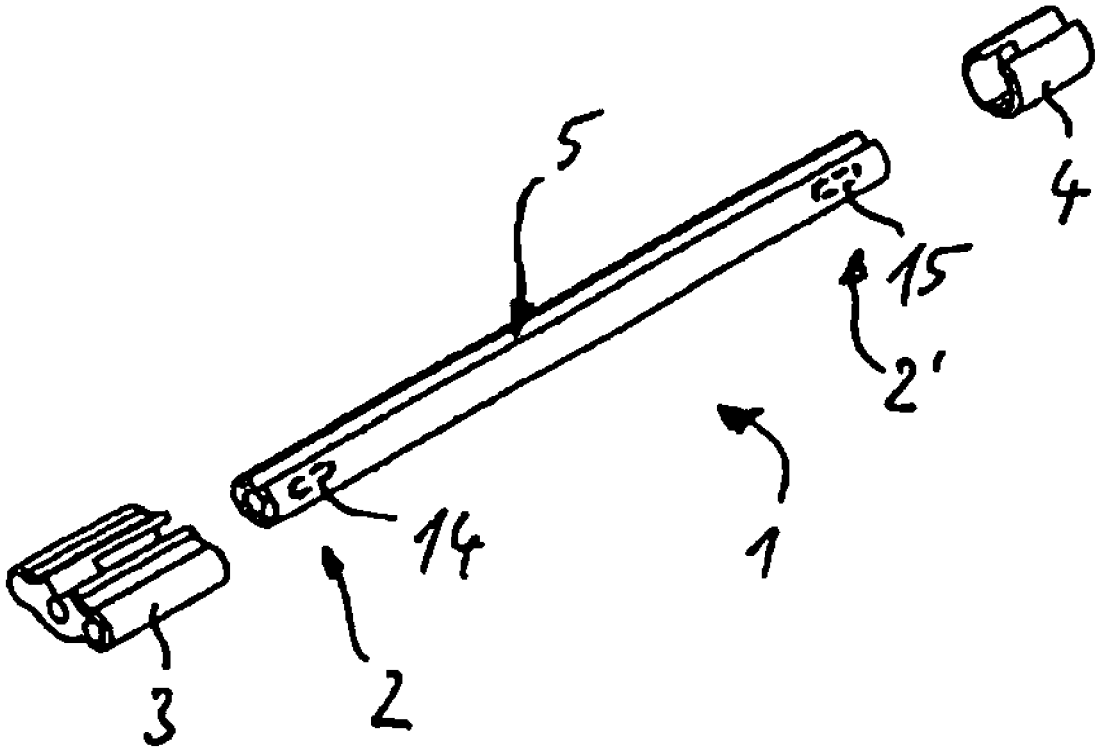
FIG. 1 is an exploded perspective view of a jacket conduit having a head element at one and an end cap at its other end according to a first embodiment of the invention.
Figure 2:
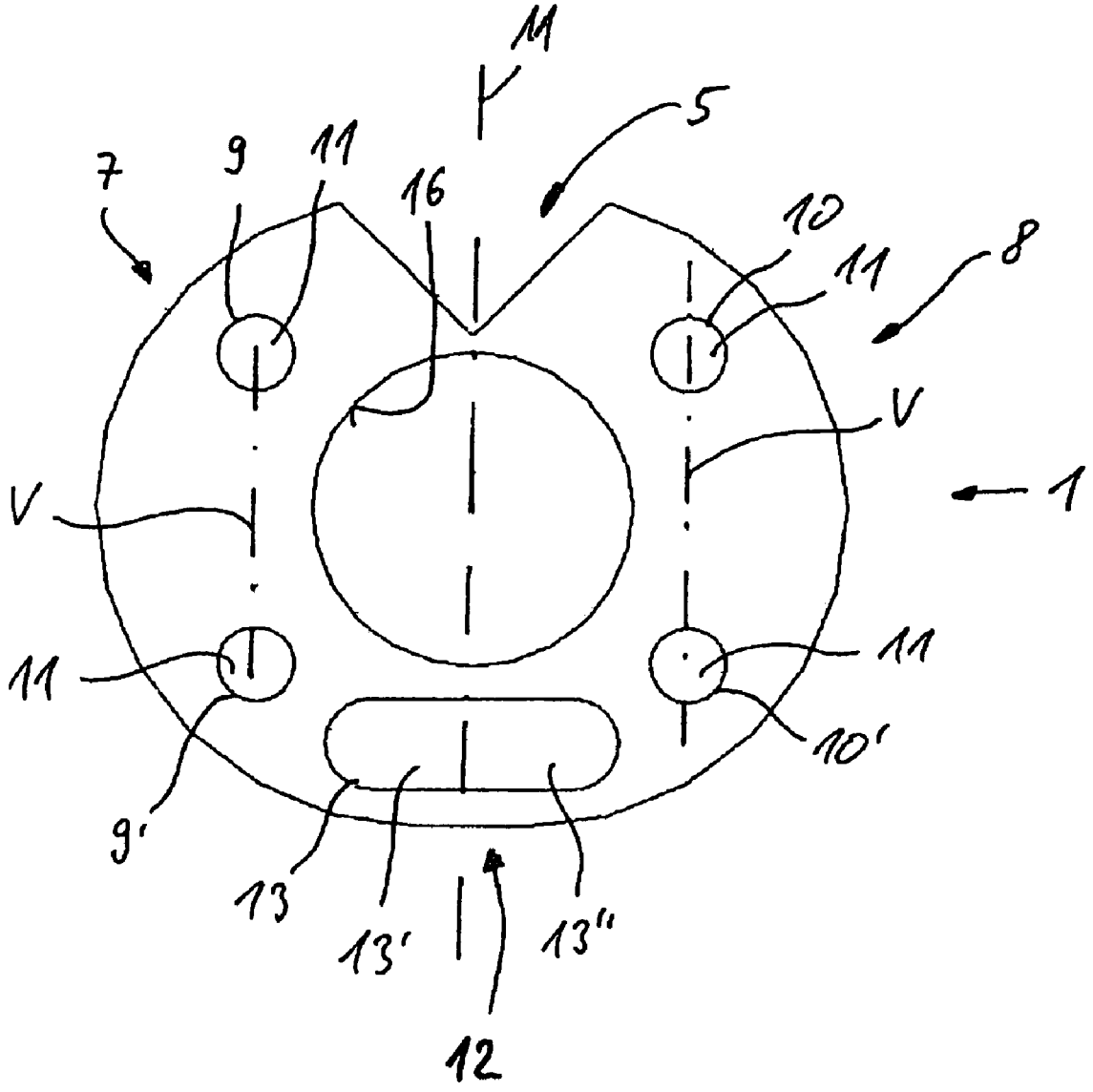
FIG. 2 is a cross section through the jacket conduit according to FIG. 1.

FIGS. 1 and 2 show a jacket conduit 1 of a first embodiment which by means of a head element 3 attached to a first end 2 thereof is connected to a regulating unit via an electric cable (not shown). In addition, the jacket conduit 1 is by means of said head element 3 secured to a holding means which serves to support a fluid filled container. A fluid line carrying the fluid to a receptor is connected to the fluid container. The jacket conduit 1 is provided with a sealing end cap at the end 2' facing the receptor.

Alternatively, the device according to this present invention may be used in conjunction with dialysis systems.

The jacket conduit 1 is made of a flexible plastic material and has an annular cross section. The jacket conduit 1 is provided with a longitudinal slot 5 across which the fluid line can be inserted or placed into a cylindrical cavity 6 of the jacket conduit 1. While in temperature controlled heating state, the fluid line is almost completely surrounded by a first circumferential section 7 and a second circumferential section 8 of said jacket conduit 1.

As may be seen more clearly seen from FIG. 2, said first circumferential section 7 and said second circumferential section 8 are disposed along both sides of a longitudinal center plane M of the jacket conduit 1 which extends through the longitudinal slot 5. The first circumferential section 7 and the second circumferential section 8 each comprise two continuous longitudinal channels 9, 9' and 10, 10', respectively, through which cylindrical heating elements 11 extend. The heating elements 11 are provided in the form of heating wires or heating fabrics which are electrically connected to a not-shown regulating unit as electric conductors. The end cap 4 and/or the head element 3 are for this purpose fitted with not-shown circumferential bridge means such that an electric current of predetermined strength may be fed into the head element 3 through a multiwire feeder cable for temperature controlled heating.

The heating wires 11 are disposed around the cavity 6 at equal radial spacings. An imaginary junction face V between the heating elements 11 of the first circumferential section 7 and/or those of the second circumferential section 8 extends parallelly to the longitudinal center plane M. The heating wires 11 are placed into an extrusion molding tool as inserts such as to ensure that a dense and durable encapsulation of said heating wires 11 by the plastic material of the jacket conduit 1 may be achieved when extruding the jacket conduit.

Extending through a junction area 12 between the first circumferential section 7 and the second circumferential section 8 of the jacket conduit 1 is a continuous hollow channel 13 in a first end section 2 of which a temperature sensor 14 to detect the temperature at the inlet of the jacket conduit 1 and in a second end section 2' of which a second temperature sensor 15 to detect the temperature in an outlet region of the jacket conduit 1 are disposed. Said temperature sensors 14, 15 are arranged in a positive or tight fit mode in said first and second end sections 2, 2', respectively. Contact lines extend through the hollow channel 13 from each of the temperature sensors 14, 15 to the head element 3 and from there on to the regulating unit via the feeder cable. The strength of the electric current to be fed to the heating wires 11 or heating fabrics or heating elements for the fluid to be supplied to a receptor at a predetermined temperature of 37° C., for instance, is in a regulating circuit of the regulating unit determined on the basis of the temperatures detected by the temperature sensors 14, 15 in the inlet and outlet regions of the jacket conduit 1. The temperatures of the inlet temperature sensor 14 and the outlet temperature sensor 15 are used to set the desired temperature and/or the electric current strength as manipulated variable such that in case of any variation of the fluid inlet temperature detected by the first temperature sensor 14 already a change of said variable is effected in the sense of a continuous follow-up of the actual-to-desired fluid temperature condition.

The hollow channel 13 is arranged symmetrically to the longitudinal center plane M and has the cross section of a long hole. A first half of the hollow channel 13' is allocated to the first circumferential section 7 and a second half of the hollow channel 13" to the second circumferential section 8. The cross section of the hollow channel 11 is relatively larger than that of the heating channels 11 and the hollow channel is substantially filled with air. The hollow channel 13 may be used to ensure homogeneous heat introduction across a wall 16 of the cavity 6 since its thermal conductivity is higher than that of the plastic material of which the jacket conduit 1 is constituted.

Figure 3:
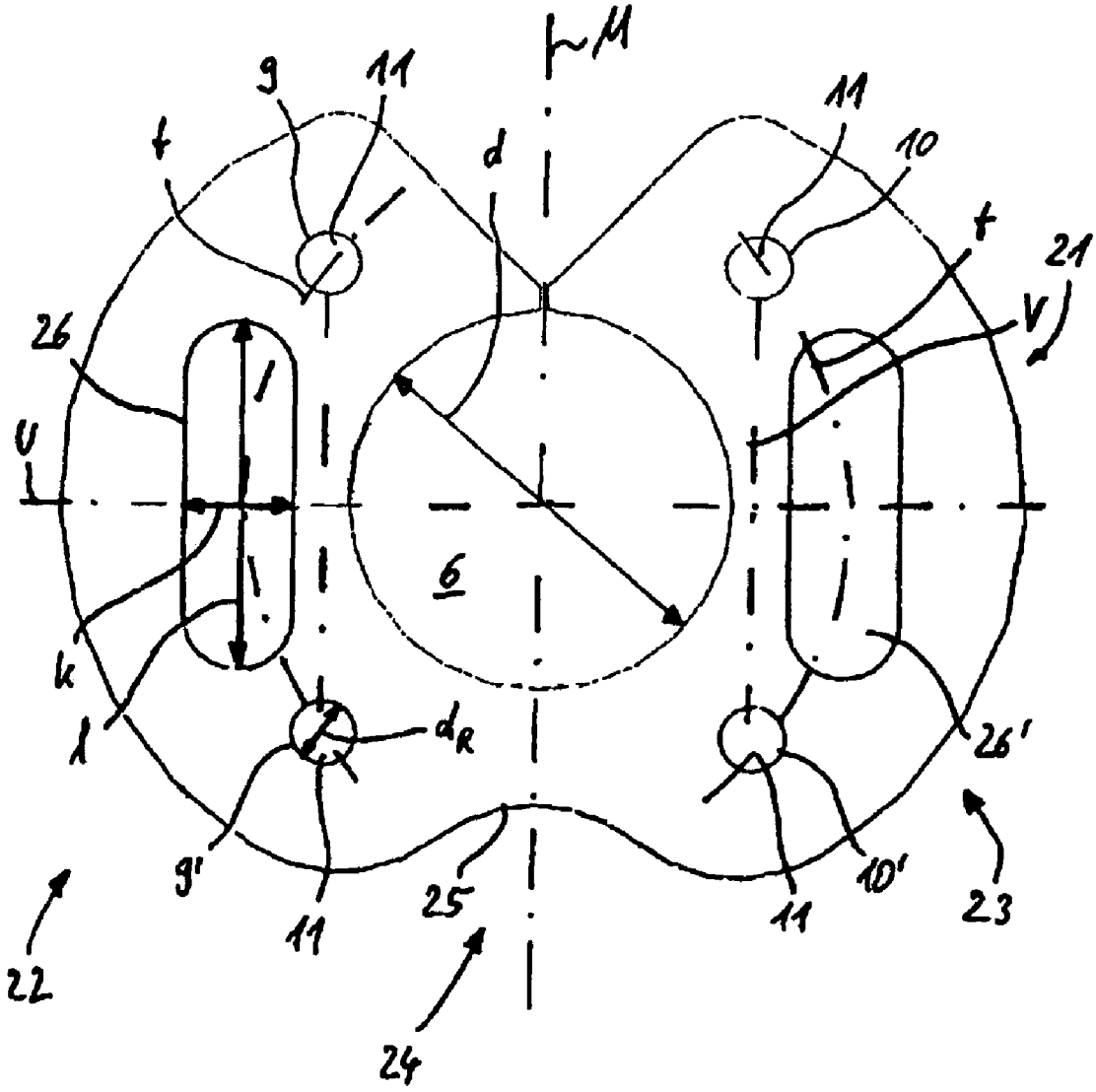
FIG. 3 is a cross section through a jacket conduit according to a second embodiment of an invention.

A second embodiment of the invention as shown in FIG. 3 provides for a jacket conduit 21 having a first circumferential section 22 and a second circumferential section 23 which each have the cross-sectional shape of a kidney. A longitudinally extending notch 25 is formed outside a junction area 24 between said first and second circumferential sections 22, 23 to increase the flexibility of the jacket conduit 21, especially when inserting the fluid line into and/or removing it from the cavity 6 of said jacket conduit 21. All components or functions that are identical in the first and the second embodiment are denoted by like reference characters.

Just like in case of the first exemplary embodiment are the first and second circumferential sections 22, 23 each provided with two heating lines 11 whose imaginary junction area V extends parallelly to the longitudinal center plane M. One hollow channel 26, 26' each extends through a central area of said first and second circumferential sections 22, 23 between the heating channels 11 wherein the first temperature sensor is disposed in the hollow channel 26 and the second temperature sensor in the second hollow channel 26'. The temperature sensors are each arranged in opposed end portions of the jacket conduit 21. The hollow channels 26, 26' as well as the longitudinal channels 9, 9' and 10, 10' of the first circumferential section 22 and the second circumferential section 23, respectively, are arranged symmetrically to the longitudinal center plane M. The longitudinal channels 9, 9', 10, 10' and/or the hollow channels 26, 26' extend substantially along a pitch circle t of said circumferential sections 22, 23. Homogeneous introduction of heat into the fluid line is ensured this way.

The hollow channels 26, 26' and/or the longitudinal channels 9, 9', 10, 10' are so arranged in the first circumferential section 22 and the second circumferential section 23 that they extend symmetrically to a longitudinal center plane U of said latter. The center plane U is perpendicular to the longitudinal center plane M of the jacket conduit 21.

The hollow channel 26, 26' has a long transversely extending portion 1 which is as long as or longer than the diameter d of the cavity 6 of the jacket conduit 21. The hollow channel 26, 26' has a short transversely extending portion k whose length substantially conforms to the diameter $d_R$ of the longitudinal channel 9, 9', 10, 10'.

Alternatively, the hollow channel 26, 26' may be of a curved configuration in which case the transversely extending portion d extends over the pitch circle t.

Insertion or placement of the fluid line into the cavity 6 of the jacket conduit 1 ensures a conductive and convective type of heat transfer from the heating elements 11 to the fluid leaving the jacket conduit at the downstream end thereof.

An alternative embodiment of the invention provides for the heating elements to be integrated in a jacket conduit consisting of fabric in which case said fabric type jacket conduit includes electrically conductive strands such that the whole jacket conduit gets homogeneously heated after connection to a supply source.

According to another embodiment of this invention the heating elements as such may be in the form of a rounded fabric.

Alternatively it is possible also to dispose the temperature sensors 14, 15 in any area of the jacket conduit 1. It is however essential to have said temperature sensors 14, 15 arranged in a spaced-apart relation.

The invention claimed is:

1. A device for temperature controlled heating of a fluid line comprising:

a jacket conduit made of a flexible material and provided with a longitudinal slot across which a fluid line is insertable into a cavity of the jacket conduit;

at least one heating element extending in longitudinal direction of said jacket conduit; and one temperature sensor each is arranged in a first and a second section of the jacket conduit, wherein at both sides of a longitudinal center plane extending through the longitudinal slot the jacket conduit is provided with at least one circumferential section having a plurality of continuous longitudinal channels or intermittent longitudinal channels which are adapted to accommodate at least two heating elements and at least one temperature sensor, said continuous longitudinal channels or intermittent longitudinal channels extending symmetrically to said longitudinal center plane of the jacket conduit or to a center plane of said circumferential section, and wherein a further channel extends between the longitudinal channels for the heating elements in which further channel at least one temperature sensor and at least one contact line connecting said temperature sensor to a regulating unit are installed.

2. The device according to claim 1, wherein the circumferential section of the jacket conduit comprises two longitudinal channels each to receive one heating element, an imaginary junction area between said longitudinal channels extending parallelly to said longitudinal center plane of the jacket conduit.

3. The device according to claim 1 or 2, wherein a hollow channel extends between the longitudinal channels for the heating elements in which hollow channel at least one temperature sensor and at least one contact line connecting said temperature sensor to a regulating unit are installed.

4. The device according to claim 1, wherein a first circumferential section and a second circumferential section each include a hollow channel having the cross section of a long hole and extending between two longitudinal channels to accommodate the heating elements, and wherein the longitudinal center plane extends in parallel to the longitudinal center plane of the jacket conduit.

5. The device according to claim 1, wherein the heating element is embedded in and tightly surrounded by the circumferential section of the jacket conduit.

6. The device according to claim 1, wherein an insert heating element is encapsulated by an extruded circumferential section of the jacket conduit.

7. The device according to claim 1, wherein the temperature sensor is retained in the end portion of the hollow channel in a positive or tight fit mode and the cross section of the contact lines of the temperature sensor is essentially smaller than that of the hollow channel.

8. The device according to claim 1, wherein the jacket conduit comprises a first circumferential section and a second circumferential section having the cross-sectional shape of a kidney, and wherein a longitudinal notch extending within a junction area between said first circumferential section and said second circumferential section is provided.

* * * * *